United States Patent [19]

Gidseg et al.

[11] Patent Number: 5,048,233

[45] Date of Patent: Sep. 17, 1991

[54] REFRIGERATOR DOOR AND METHOD OF MANUFACTURING SAME

[75] Inventors: Edward D. Gidseg, Manhasset; Jan Ganik, Fresh Meadows, both of N.Y.

[73] Assignee: Northland Corporation, Greenville, Mich.

[21] Appl. No.: 576,145

[22] Filed: Aug. 29, 1990

Related U.S. Application Data

[63] Continuation of Ser. No. 45,647, May 1, 1987, abandoned.

[51] Int. Cl.[5] ..... E06B 3/00

[52] U.S. Cl. ..... 49/501; 49/DIG. 1; 126/198

[58] Field of Search ..... 49/501, DIG. 1; 52/98, 52/309.11; 126/198

[56] References Cited

U.S. PATENT DOCUMENTS 3,334,464 8/1967 Charles ..... 49/501
3,453,997 7/1969 Klepzig ..... 126/198
3,634,971 1/1972 Kesling ..... 49/501
4,423,578 1/1984 Meigs ..... 49/DIG. 1

*Primary Examiner*—James R. Brittain
*Assistant Examiner*—Gerald A. Anderson
*Attorney, Agent, or Firm*—Warner, Norcross & Judd

[57] ABSTRACT

A refrigerator door is disclosed which comprises a plurality of extruded aluminum frame members of predetermined configuration, each having a number of channels on its inner surface; L-shaped alignment pins for attachment of the frame members to each adjacent member so as to form a frame of predetermined configuration, a groove for thermally insulating a front portion of the extruded aluminum members from a rear portion; front and rear panel members positioned in parallel non-contacting substantially perpendicular alignment in the channels of the frame members; a thermal insulation medium positioned within the space between the frame members and the front and rear panels; and hinge brackets for mounting the frame members upon a refrigeration cabinet by hinged connections.

17 Claims, 5 Drawing Sheets

REFRIGERATOR DOOR AND METHOD OF MANUFACTURING SAME

This is a continuation of copending application Ser. No. 07/045,647 filed on May 1, 1987, now abandoned.

TECHNICAL FIELD

This invention relates to a door and a method for manufacturing the same In particular the invention relates to a refrigerator door which serves as an effective thermal insulation barrier between the cold air inside the refrigerator and the warmer air outside of it.

BACKGROUND ART

The automatic home refrigerator consists essentially of a double-walled box with a hinged door, the space between the walls of the box being filled with an insulating material. The outer walls, comprised of steel sheets, generally have an exterior finish of baked enamel. The interior walls, when constructed of steel sheets, are usually finished with an acid-resistant porcelain enamel.

The door is generally double-walled and insulated to offset the thermal conductivity of the materials used in its construction. A gasket on the frame maintains a seal and prevents the leakage of warm air into the box when the door is closed.

Insulated doors for refrigerators, freezers and other insulated cabinets are usually constructed of two main components; an outer "face" and an inner "drum". The hollow chamber defined by these two members is then filled with an insulation material such as a foamed polyurethane which is poured into the chamber in liquid form and foamed in-situ.

To secure the drum to the door face the most common approach has been to use screws or bolts extending through the opposed peripheral edges of the door face and the drum. Alternatively, a bridging strip may be used where the drum and face are both made of metal. In this structure the strip may be welded to the edges of the drum and the face.

Both of these approaches to assembling the door drum and face have a serious drawback in that the drum and the face, that is, the inner and outer surfaces of the insulated door, will be subjected to significantly different temperatures. For example, a freezer may be operated with its interior temperature at around 0° F. or below, while the outside temperature i.e. the temperature of the room in which the freezer is located may well be 80° F. or more. This results in a thermally induced relative movement between the inner and outer surfaces of the insulated door. Thus where the drum is fixed to the face by screws or other rigid fasteners, cracking and other damage to the door will often result.

Suggested solutions to this problem have included the use of a snap-in inner door liner, such as shown in U.S. Pat. No. 3,882,637, which is designed to permit relative movement between the inner and outer door components. Interfitting joints have been used between the door face and drum, as in U.S. Pat. Nos. 3,883,198 and 3,915,527. The joints are designed to permit sliding movement between the interengaging edges of the two door components.

Obviously, where the inner liner of the door is of larger size than the opening in the door face into which it is positioned (to provide a snap-in construction), special handling and manipulation of the door components during assembly is required. By the same token where an interfitting edge construction is utilized it will be apparent that these edges must be rolled or otherwise formed to provide the reversely bent edges along the door components.

A similar, related problem in the construction of insulated cabinet doors has been the attachment of the sealing gasket to the door. These gaskets are resilient and often magnetic and designed to be interposed between the inner surface of the door and the opposing portions of the cabinet to form an air-tight seal.

Quite often such gaskets are attached to the drum of the door by means of threaded fasteners, as shown in U.S. Pat. No. 3,078,003, wherein the same screws which secure the gasket to the door also secure the drum to the face of the door. A somewhat similar construction is shown in U.S. Pat. No. 3,359,053, wherein the bolts or screws which secure the drum to the door face also pass through clips which engage the gasket and hold it in place.

Both constructions present the same problems as those described above with respect to the attachment of the door drum to the door face. Namely, that by providing a rigid connection between the edges of the door drum and face, when thermally induced relative movement between these components occurs there is a tendency for the components to crack or otherwise become damaged.

Another approach is shown in French Pat. No. 1,362,178 wherein the sealing gasket also performs a second function of attachment to hold the door face and door drum together while a foamed in-situ material is cured to thereafter serve as a structural component of the door. However, with this construction, the gasket is permanently embedded in the door, rendering it virtually impossible to remove it for replacement or repair. Additionally, the protruding gasket which must be positioned in place during the foaming operation is obviously positioned such that it can be easily damaged during handling of the door immediately prior and subsequent to the foaming operation.

While the above-noted French patent also discloses an embodiment in which the gasket appears to be removable, in this embodiment the door drum and door face are not provided with securing means during the foaming operation, but are presumably held in position with respect to each other with some type of fixture which is not disclosed. Suffice it to say that maintaining the door components in the desired position solely by means of the fixture holding the door during the foaming operation would be extremely difficult if not impossible from a practical point of view.

In U.S. Pat. No. 4,053,972, the main door components i.e., the door face and drum, are interconnected without the use of threaded fasteners such as screws or bolts. Instead a hardened, insulating material which is formed in-situ forms the main interconnection between the door face and drum, thereby securing them together. In constructing the door, S-shaped retainers are used which receive in their oppositely opening loops the edges of the face and drum. Temporary spacers are then interposed between the face and drum edges for the foaming operation. Following the filling of the door cavity with insulating material the spacers are removed and an anchoring leg of a gasket is snapped into place into the cavity left by the removal of the spacers, securing the gasket to the door without the use of screws or other mechanical fasteners, but permitting the gasket to be removed as necessary for replacement or repair. This process, while accommodating thermally induced relative movement between the two main door components, entails further, more complex construction steps not required in the present invention. I have invented a door for refrigerators or the like which avoids the above-noted disadvantages.

SUMMARY OF THE INVENTION

Broadly stated, one embodiment of our invention relates to door means for at least partially obstructing an opening in cabinet means comprising a plurality of frame members of predetermined configuration, each of which has at least two channels on its inner surface and is positioned in end to end engaged relation with an adjacent member. The attachment of the frame members forms a rectangular frame of predetermined dimensions. Front and rear panel members are configured and adapted for insertion into the channels in order to enable them to be retained in parallel spaced relation. The door also comprises means for mounting the plurality of frame members upon structural members such as a cabinet wherein the mounting means is attached to the opposed frame members.

In addition, a thermal insulation medium can be positioned within the space defined between the frame members and the front and rear panel members when an insulated door is desired. Such insulated door may also include means for insulating a front portion of each of the frame members from a rear portion closer to the rear panel member of the door. Thus, the insulating means may include a space between the front and rear portions of the frame members to break the thermal conductivity therebetween. Additionally, the thermal insulation medium preferably comprises polyurethane foam.

Generally, the frame members are aluminum extrusions and four of such extrusions are used to form a frame which defines the perimeter of the door. The top and bottom aluminum extrusions of the door each include means for reception and retention of the mounting means. These mounting means have separate top and bottom hinge brackets connected to the top and bottom aluminum extrusions, respectively, wherein each hinge bracket comprises a generally elongated rectangular portion and an aperture for connection to the cabinet means. Attaching the frame members entails the use of L-shaped brackets, dimensioned and adapted for insertion into correspondingly dimensioned and positioned grooves located in the end portions of adjacent aluminum extrusions by a press-fit. Similarly, the mounting means can be press-fit into the reception means.

For decorative doors, at least one of the frame members should include facing means capable of attachment to a side portion of each frame member to provide decorative facing, while a decorative panel may be located in parallel spaced relation in front of the front panel means.

BRIEF DESCRIPTION OF THE DRAWINGS

Further benefits and advantages of our invention will become apparent from a consideration of the following description given with reference to the accompanying drawing figures which specify and show preferred embodiments of the present invention, and wherein.

DETAILED DESCRIPTION OF THE PREFERRED EMBODIMENTS

Figure 1:
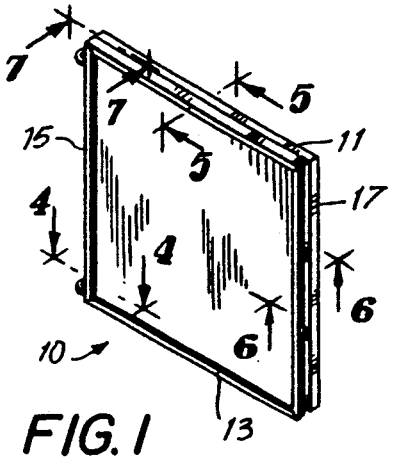
FIG. 1 is a perspective view of a door according to the present invention.

Referring initially to FIG. 1, there is illustrated a fragmented view of a door 10 according to the invention. This view shows the arrangement of the extruded frame members which make up the frame of the door 10. These members include top 11, bottom 13, hinge side 15 and handle side 17 members, and are connected at their corners to form a frame which holds the inner and outer panels, insulation, decorative facing, handle, and hinges together as a door assembly. The various configurations of these frame members are detailed and illustrated in FIGS. 3-9.

Figure 1A:
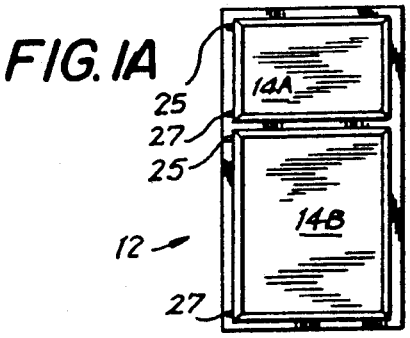
FIG. 1A is a front view of a refrigeration cabinet with top and bottom doors according to the invention.

FIG. 1A illustrates a refrigerator cabinet 12 having two doors 14A, 14B according to the invention, positioned in vertical alignment. For example, upper door 14A may provide access to a freezer compartment, while lower door 14B may provide access to a refrigerator compartment of refrigerator cabinet 12. These doors are each mounted to the cabinet at upper hinge 25 and lower hinge 27. Preferred hinges are disclosed in our copending applications Ser. No. 855,050, filed Apr. 23, 1986 now U.S. Pat. No. 4,774,740, and Ser. No. 07/045,647, filed May 1, 1987, entitled HINGE ASSEMBLY. The disclosure of these patent applications are each expressly incorporated by reference herein. Also, a preferred power module for a refrigeration cabinet is disclosed in copending application Ser. No. 021,600, filed Mar. 2, 1987, now U.S. Pat. No. 4,776,182, the content of which is also expressly incorporated by reference herein.

The metal members which represent the door frame contain grooved channels of varying predetermined configurations. The configurations of these channels also permit the insertion of outer and inner panels 16, 18 in substantially vertical, non-contacting alignment to form the outer and inner surfaces, respectively, of the door. The metal members are preferably constructed of extruded aluminum and are attached to each other by press fit L-shape alignment pins generally designated as 24. Screws, rivets, bolts or adhesives such as glue or epoxy may also be used if desired; however, assembly of the door is simplified and quickly accomplished by the alignment pins 24 without the need for other securement means.

One skilled in the art will note that the metal members may be extruded in a variety of configurations while still performing their assigned functions. The configurations illustrated in FIGS. 3–9, however, disclose the preferred embodiments of the invention.

Figure 2:
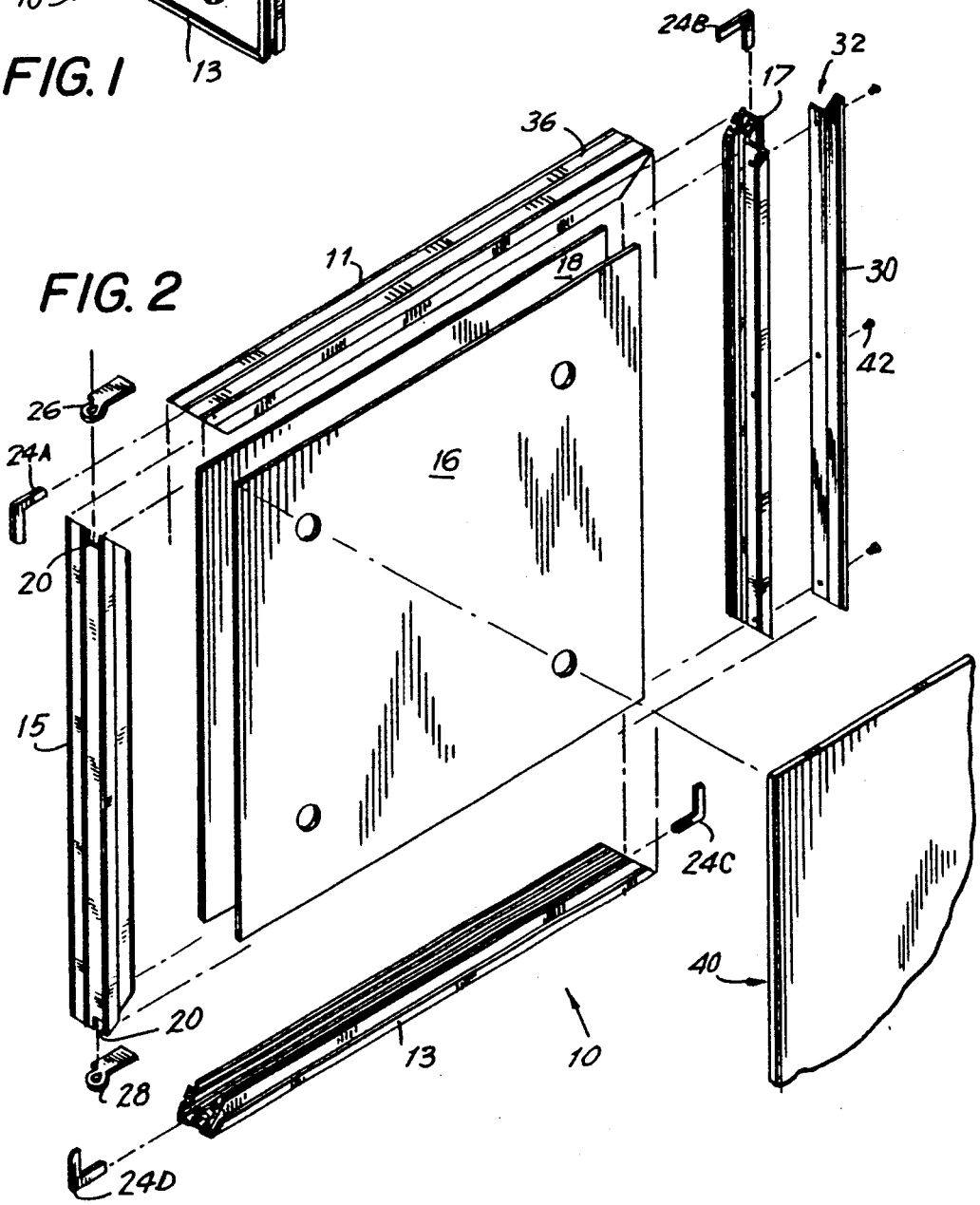
FIG. 2 is an exploded view of the door of FIG. 1, with components shown separately.

Referring now to FIG. 2, there is illustrated an exploded view of the door of FIG. 1. This view shows how outer and inner plates 16 and 18, which form the outer and inner surfaces, respectively, of door 10, are positioned in engagement with the surrounding channels of the extruded aluminum members. When used as a door for a refrigeration cabinet, the space between the plates 16 and 18 may be filled with an insulating material, such a polyurethane foam, to further retard the transfer of heat and cold through the door. Alternately, any insulating material may be used.

In the assembly of the door 10, the ends of the aluminum members are cut at a 45° angle for proper mating and alignment in the eventual forming of a rectangular frame. Each member includes an elongated, rectangular groove generally designated as 50 for receiving one end of the L-shaped alignment pin 24. These pins 24 are press-fit into the groove 50 to provide a secure joint for the members of the door frame. The groove is designed to allow the 45° corners of adjacent members to be precisely aligned. Top member 11 and bottom member 13 each include a second elongated groove for reception of the respective hinge bracket 26 or 28. The hinge bracket extends in a direction parallel to the member to which it is attached, so that the side member 15 must be configured with slots 20 to allow the insertion of each hinge bracket to extend therethrough. The opposite end of the hinge bracket contains an eye which attaches to the corresponding hinge mount (not shown). Side member 17 is also configured to receive handle 30.

The assembly sequence is as follows: front and back plates 16, 18 are positioned in spaced relation while any one of the four aluminum members is attached along one edge of each of the plates. Thereafter, an L-shaped pin is inserted into each end of the member. For example, if top member 11 is initially used, it is attached to the top edge of each plate 16, 18. Adjustment pins 24A and 24B are then inserted into the appropriate rectangular groove at each end of member 11. Frame members 15 and 17 are attached to pins 24A and 24B, respectively. Members 15 and 17 each also engage the respective side edges of plates 16, 18 to retain their spaced relation. Pins 24C, 24D are attached to bottom member 13 before this bottom member 13 engages the bottom edge of plates 16 and 18. By sliding members 13 onto the edges of plates 16, 18, pins 24C and 24D engage the respective grooves of side members 17 and 15. Finally, hinge brackets 26 and 28 are inserted into the hinge side of the frame members 11 and 13, respectively.

Next, the door 10 is filled with foam forming components which react to form a foam 44 that adheres to the components and creates a unitary door structure to complete the assembly. As one skilled in the art would realize, the door components must be maintained in a mold during the foaming process so that no warpage or distortion of the door occurs due to the forces of the expanding foam. Thereafter, handle 30 and, optionally, decorative facing 40, are attached to the door 10 to place it in condition for attachment to the hinge mounts of the cabinet.

As noted above, the frame members are attached to each other by the L-shaped alignment pins 24 because the foam contributes to the overall strength and rigidity of the completed door structure; however, other means, such as rivets, bolts or the adhesives mentioned above, may be utilized in conjunction with the alignment pins when a stronger or more secure door construction is desired.

Upper hinge bracket 26 and lower hinge bracket 28 are attached to the members 11 and 13 of door 10 subsequent to the completion of assembly of the frame members. Brackets 26 and 28 serve to facilitate the insertion of an upper and lower hinge assembly connecting the frame of door 10 to the frame of the refrigeration cabinet of FIG. 1A, for example, thus permitting door 10 to be opened and closed.

Door 10 may be constructed so as to open in either direction, i.e., with a left hand hinge or right hand hinge, as chosen by the consumer. Depending upon the direction of staged rotation desired, the location of the frame member and associated hinge brackets 26 and 28 will then be selected. For example, if the hinge is positioned on the left hand side of the door and the attached upper and lower hinge assemblies connect the door at this point to the frame of the refrigeration cabinet, the door will open as a right hand door. If the consumer wishes a left hand door, i.e., a door which opens from left to right, the position of the frame member forming the side of the door frame to which hinge brackets 26 and 28 are attached, must be reversed. This can easily be accomplished by inverting the door prior to the mounting thereof. In either case, handle member 30 is normally positioned on the side of door 10 opposite from the hinge assemblies for maximum leverage in opening or closing door 10.

FIGS. 3–9 illustrate cross-sectional views of preferred configurations for the various extruded metal members which form the frame of door 10.

Figure 3:
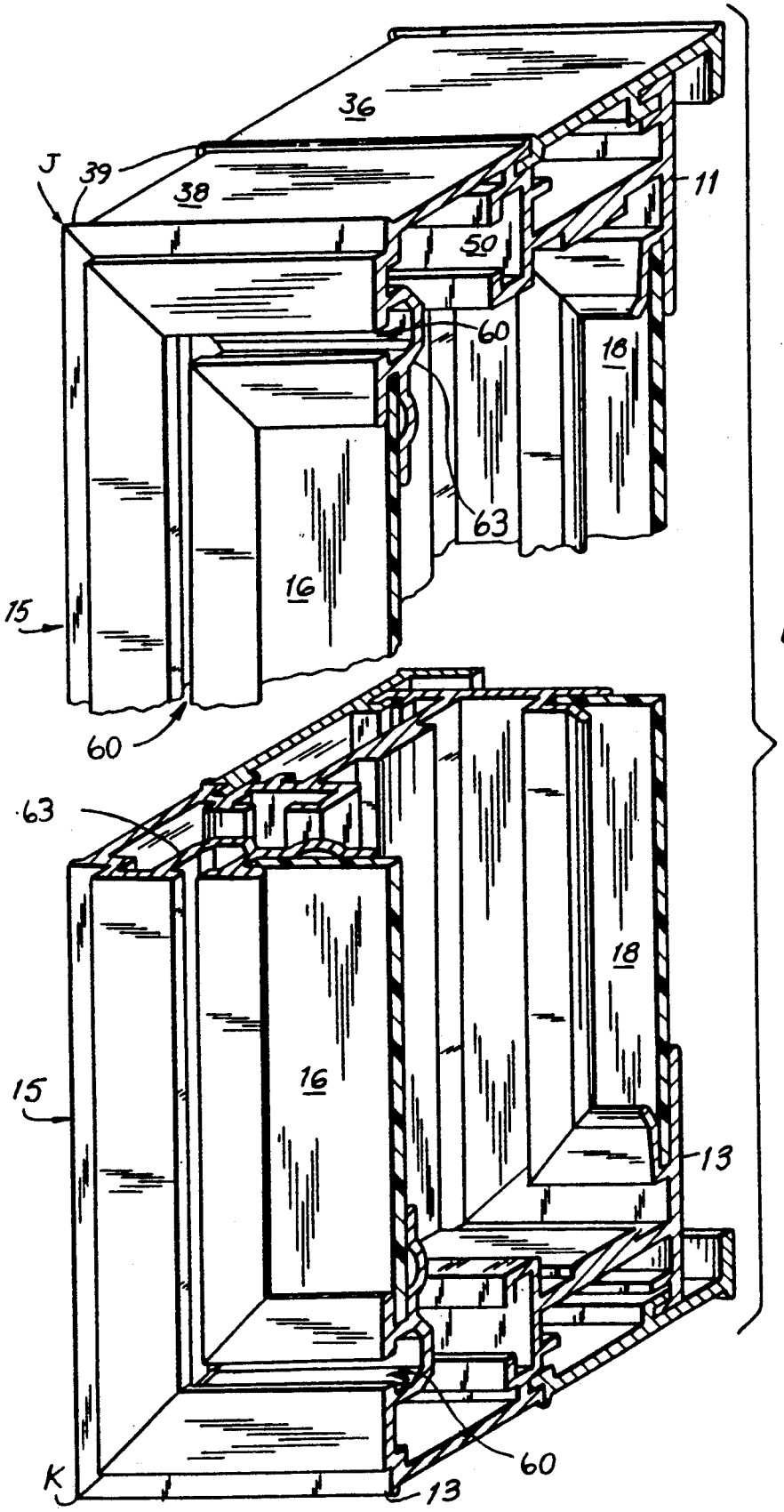
FIG. 3 is a cross-sectional view of a extruded metal member which forms one side of the frame of the door.

Referring now to FIG. 3 there is illustrated a detailed cross-sectional view of extruded metal member 15 which is used in forming the hinge side segment of the frame of door 10. As shown in FIG., one end of side member 15 meets top member 11 at 45° angle at J while the other end of side member 15 meets member 13 at K. This FIG. also shows the placement of the edges of side panels 16, 18 in the channels of the aluminum frame members.

As shown in FIG. 3, each of the extruded metal members of the frame 15 is formed with a continuous, longitudinal slot on the inner side of the frame, disposed between the perimeter of the inner panel 18 and the outer perimeter of the frame. As the frame members are initially formed, before the door assembly is completed, the slot is formed of a generally U-shaped, continuous wall 63 extending across the slot and inwardly toward the interior space of the door defined between the frame members and the inner and outer panels 18, 16.

Figure 4:
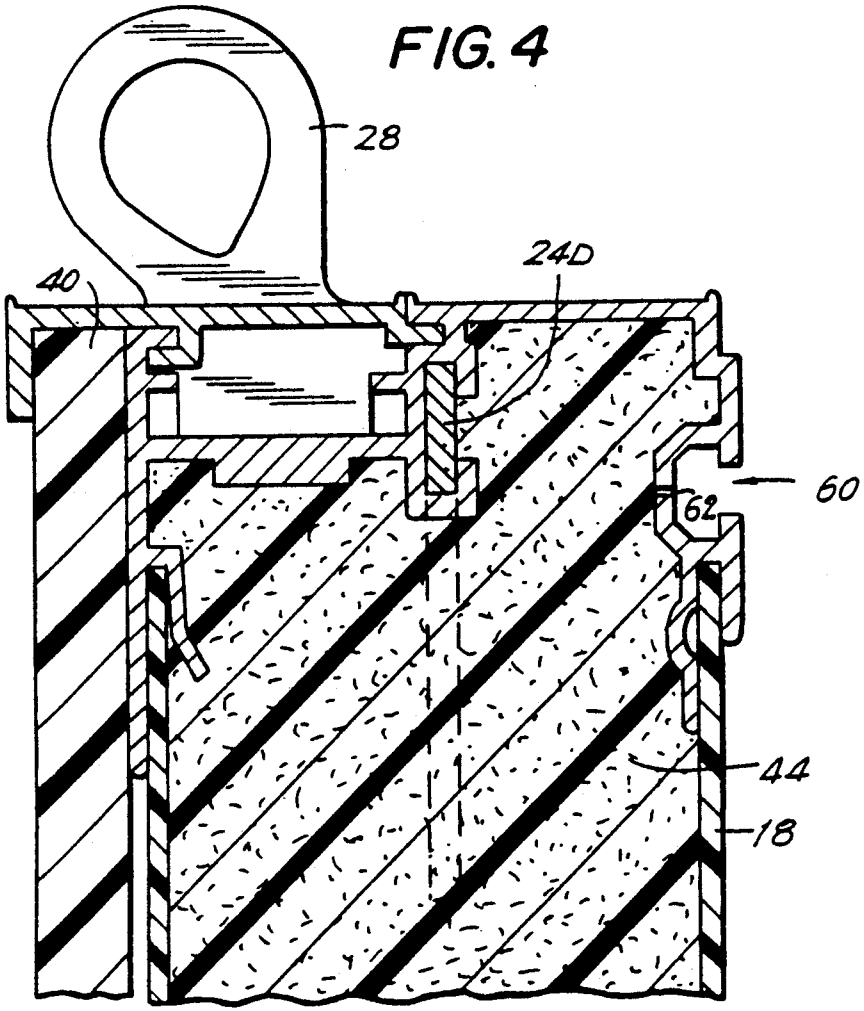
FIG. 4 is a cross-sectional view of a lower corner of the door of FIG. 1, taken along lines 4—4 of FIG. 1.

FIG. 4 is a cross-sectional view of an extruded metal member which is used to form the lower hinge side corner of the frame of door 10. Hinge bracket 28 extending from the frame is clearly visible, while L-shaped alignment pin 24D is shown in cross-section. Foam 44 holds the entire door assembly together, since it adheres to the components after formation. The foam 44 also provides insulation between the relatively cold interior portion of the refrigeration cabinet and outer portion of the door which is exposed to room temperature. Since the frame members are formed of metal, the warmer room temperature in contact with the outer portion of the door will be conducted into the colder interior portion of the cabinet due to the high thermal conductivity of the metal.

To prevent this, each frame member is provided with a slot 60 positioned at a location between the cold inner side of the door and the warm outer frame side. After the door 10 is filled with foam 44, the U-shaped wall 63 of the slot is longitudinally and continuously cut at 62 to break the thermal conductivity of the metal between the cold and warmer areas of the frame. This prevents outside heat from being conducted to the cold section of the door. As mentioned, slot 60 is provided on each frame member to enable a complete break in thermal conductivity around the perimeter of the door frame.

Figure 5:
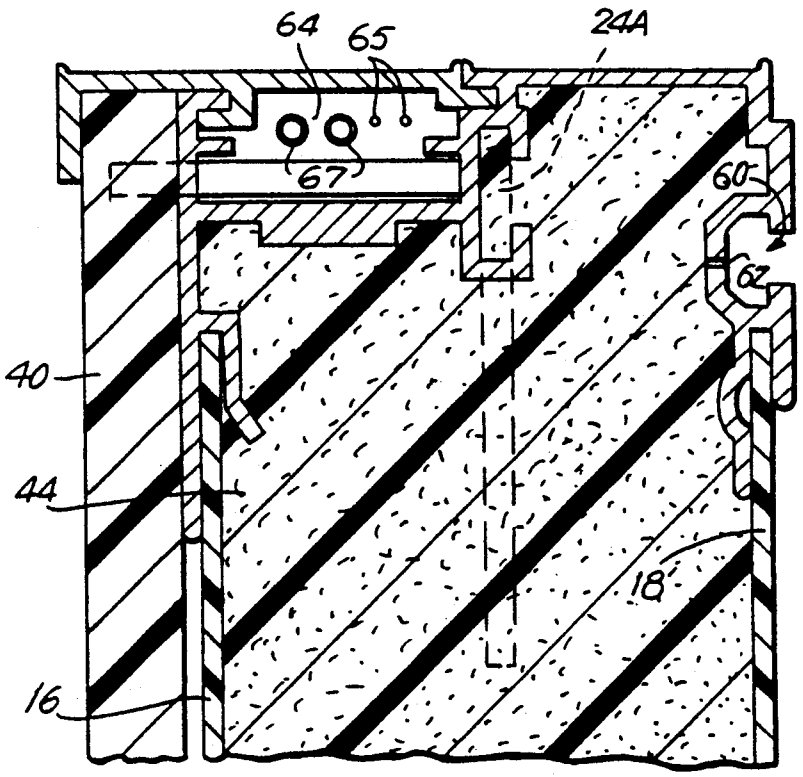
FIG. 5 is a cross-sectional view of the top extruded metal member which is used to form a side of the door of FIG. 1, taken along lines 5—5 of FIG. 1.

FIG. 5 illustrates a cross-sectional view of an extruded metal member which forms the side segment of the frame of door 10. This view clearly shows groove 64 which may be utilized for the placement of wiring 65 for the electrical portions of the power module or the inner lighting of the cabinet. In addition, this groove 64 may be used to retain water tubes and drains 67 such as those used for automatic icemakers. In particular, these tubes may be used to deliver ice and/or cold water from the inside of a refrigerator freezer to dispenser means located in door 10. Such an arrangement would permit access to both ice and cold water by the consumer without a need to open the cabinet door, thus reducing the amount energy required to maintain the cabinet interior at a preset low temperature.

Once the door is assembled, the polyurethane foam is defined by the central portion between the basic door panels 16 and 18. Once the door is assembled, the hinge is inserted into the slot at 20 and fixed in position by a screw and star washer arrangement which screws into the respective member. Once the hinges are screwed into position, a decorative panel 36 is slid into position to cover the screw so that the hinge attachment means is concealed. The decorative panel has a height which is greater than the width of the portion of the door in which it stands so that it provides a gap 28 for reception of a decorative front panel for the door. This decorative panel is preferably made of plastic and can be selected by the customer to match any desired color combination.

Along with the decorative panel 36, there is a space 38 provided between two ridges 39. Within this space is positioned a piece of decorative mylar, plastic, wood strip or the like, based on the selection by the end user. This decorative strip may be attached by adhesive means or it may be temporarily placed thereon for removal at a later date to permit replacement with a different color strip.

In the past, the aluminum door molding was required to be anodized in order to present a finished (black, gold, chrome, etc.) appearance. This finished appearance was very expensive due to the high cost of the anodizing process. For the most part, however, the anodized aluminum parts were subsequently covered by either a panel on the front side of the molding or by a rubber gasket on the inside of the molding. Therefore, the only real benefit of anodizing the entire molding was the anodized side portion, which has now been covered by (a) a strip of mylar or other plastic and (b) the door trim piece described below. Thus, it is no longer necessary to anodize these moldings in order to obtain a finished appearance. All that is necessary is to merely make a door out of raw aluminum molding. It is also no longer necessary to take extra special care to avoid marking or marring the exposed portions of the molding since they are now covered by a decorative door trim and the mylar. The remaining portions are covered by gaskets, panels, etc.

Another advantage is that the decorative door trim 36 covers the screw utilized to secure the hinge in position so that now the hinge merely juts out of the door without any apparent attachments.

There are no door molding assembly screws visible since the frame is assembled with the pressed fit L-shaped alignment pins. The decorative trim facilitates the use of a decorative panel which can be any variety of panels, namely, black plastic which may be dull or shiny, stainless steel, etc. Adjustment of the door hinge is made by merely sliding back the decorative door panel and loosening the screw, then sliding the hinge via the slot provided therein.

The wall to which the door hinge is attached now effectively plugs off the foam filled area so that after foaming, no foam appears through the hinge holes, as is the case in prior art doors. In the past, it has been necessary to attempt to keep the hinge holes plugged up and where this was unsuccessful, the hinge holes were usually filled with polyurethane foam which had to be cleaned out. This task involved additional labor costs.

Figure 6:
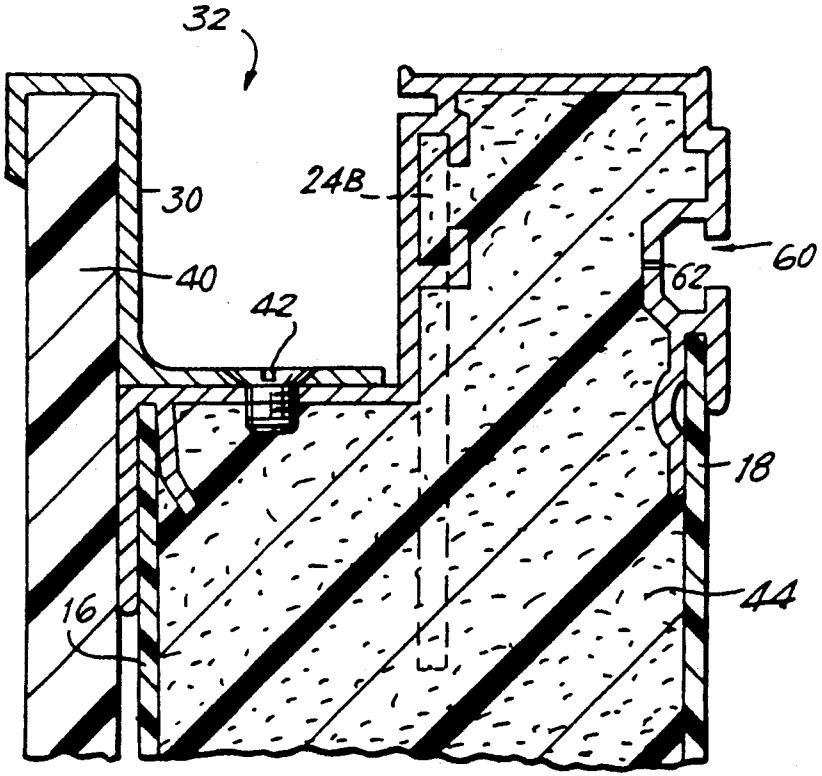
FIG. 6 is a cross-sectional view of a handle member for attachment to the door of FIG. 1 taken along lines 6—6 of FIG. 1.

Door 10 is opened and closed by means of handle 30. A cross-sectional view of handle 30 is illustrated in FIG. 6. This handle 30 is attached to the frame along one side of the door 10 by means of screws 24. Alternatively, other attachment means may be used to secure handle 30 to the door 10. As shown, the recess 32 of handle 30 provides a surface which may readily be grasped to pull the door 10 open or to push it closed, while the handle 30 is concealed from view, thus providing an aesthetically pleasing appearance.

The handle 30 is assembled and attached to the door by screws 42 to the molding forming the handle side of the door. The handle includes a decorative side surface which could be any decorative material from which the handle could be made. The handle includes a decorative front surface which may be polished aluminum or any other surface desired by the customer. Within the channel 32 formed between the outer ridge of the handle in the back "gripping portion " of the handle, a decorative front panel may be inserted to actually form the front of the door. The panel is shown at 40 and may be black or other plastic, shiny or dull, stainless steel, wood or any other desired material. It can be readily seen that gripping the door can be accomplished by gripping the handle from behind within the portion 32 which is defined between the handle and the channel body. The channel body also includes two ridges for positioning therebetween a decorative strip of mylar, wood or other decorative colored strip to match the decorative strips located on the other areas of the door.

FIG. 6 illustrates the preferred configuration for a metal member, preferably also constructed of extruded aluminum, which, when attached to the frame at the edge of door 10 serves as a handle which permits the door to be pulled open or pushed closed.

Figure 7:
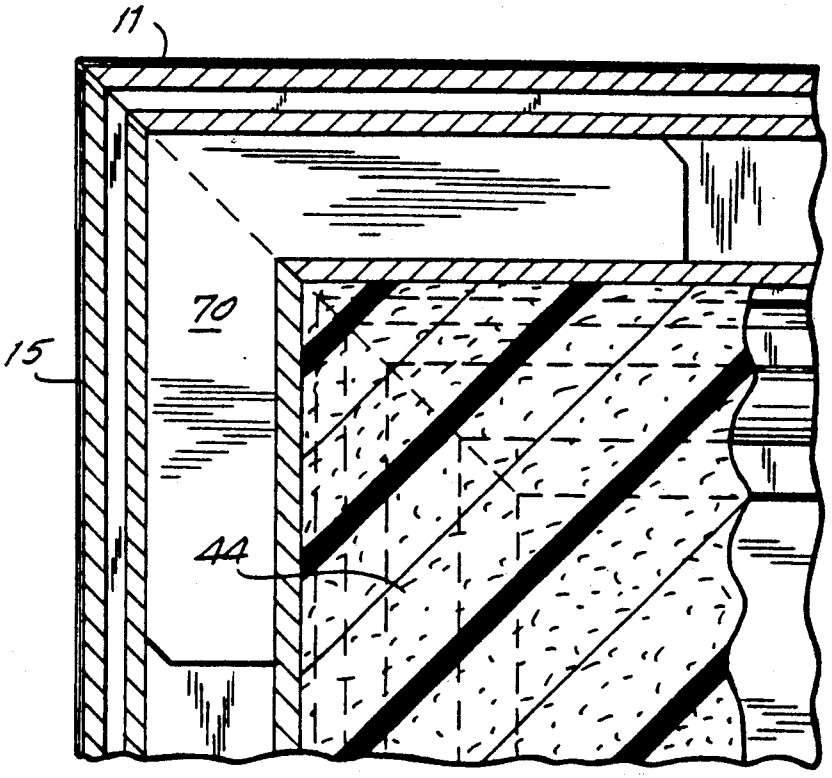
FIG. 7 is a cross-sectional view of an upper corner of the door of FIG. 1 taken along lines 7—7.

FIG. 7 illustrates the upper hinge corner of the door frame. Also shown is decorative strip 70 which is placed in groove 38 between ridges 39.

Figure 8:
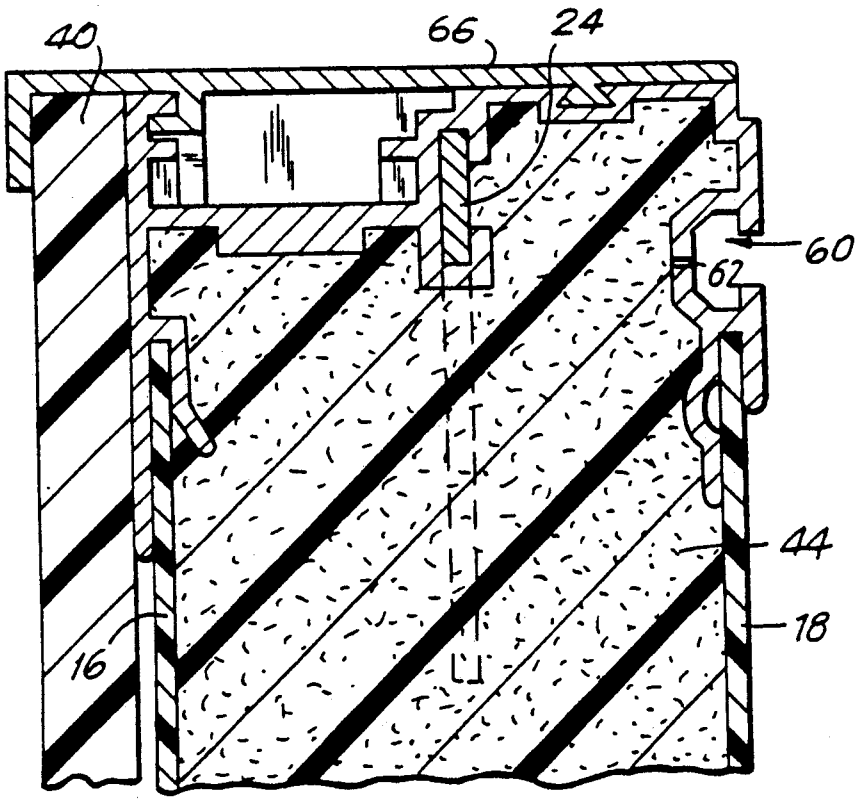
FIG. 8 is a cross-sectional view of another side member similar to that of FIG. 6.

FIG. 8 illustrates anodized cover plate 66 which can be attached to side member 17 when a full width door having decorative cover plate 60 is desired.

Figure 9:
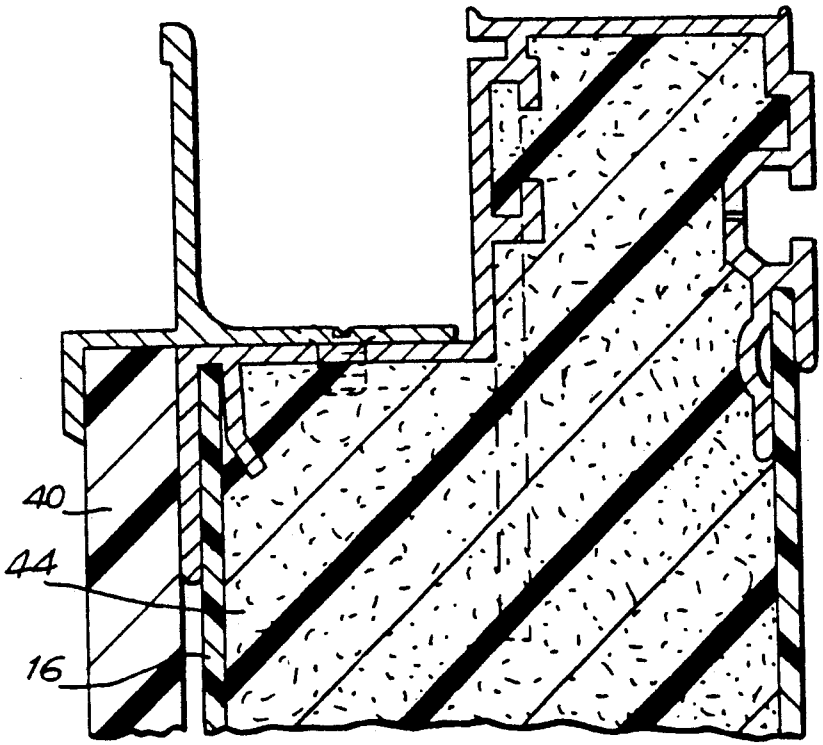
FIG. 9 is a cross-sectional view of another handle similar to that of FIG. 7.

An alternate form of the handle is shown in FIG. 9. It comprises a handle portion which forms one side of the door. In this embodiment, the handle is not hidden and the mold bracket which forms part of the handle actually facilitates the insertion of a decorative front panel for the door. From the standpoint of disguising or hiding the handle, the handle shown in FIG. 6 is preferred.

If desired, the resultant assembly may use elastomeric strips as additional thermal insulation means to ensure that metal to metal contact, which transmits heat and cold, are eliminated and replaced by metal to rubber contacts to further reduce the thermal conductivity of the door 10.

While it is apparent that the invention herein disclosed is well calculated to achieve the desired results, it will be appreciated that numerous modifications and embodiments may be devised by those skilled in the art, and it is intended that the appended claims cover all such modifications and embodiments as fall within the true spirit and scope of our present invention.

We claim:

1. A door for at least partially obstructing an opening in cabinet means of the type wherein the temperature inside the cabinet is normally different from the outside temperature, which comprises:

a plurality of frame members of predetermined configuration, each said frame member having a first section in thermal contact with the inside of the cabinet means and a second section in thermal contact with the outside of the cabinet means;

means to prevent thermal conductivity at least between portions of said first and second sections;

means to attach each of said frame members to an adjacent member so as to form a rectangular frame of predetermined dimensions;

front and rear panel members configured and adapted for insertion into said frame members so as to be retained in parallel spaced relation;

means to mount said plurality of frame members upon a structural member such as cabinet means, each of said mounting means being respectively attached to opposed frame members; and thermal insulation medium positioned within the door interior space defined between said frame members and said front and rear panel members;

said means to prevent thermal conductivity comprising a continuous slot formed in each of said frame sections disposed between said first and second sections and including a generally U-shaped wall extending across said slot and inwardly toward said door interior space, said wall having a continuous cut formed therein, wherein said first sections and said rear panels are maintained in assembled relationship with the door by adhesion to said thermal insulation medium.

2. The door of claim 1 wherein said thermal insulation medium comprises polyurethane foam.

3. The door of claim 1 wherein said frame members are aluminum extrusions and further wherein four aluminum extrusions are used to form a frame which defines the perimeter of the door.

4. The door of claim 3 wherein at least one of said aluminum extrusions is dimensioned and configured to serve as a handle so as to permit manual opening and closing of the door by gripping said extrusion.

5. The door of claim 4 wherein said extrusion is configured to provide a channel-like opening to facilitate manual gripping the extrusion by positioning of the hand of the user within said channel.

6. The door of claim 5 wherein said aluminum extrusion has a generally L-shaped configuration and is dimensioned and configured to be attached to an aluminum extrusion extending along one side of the door so as to form a channel which facilitates manual gripping thereof to open and close the door.

7. The door of claim 6 wherein the frame has top and bottom aluminum extrusions each include means for reception and retention of said mounting means.

8. The door of claim 7 wherein said mounting means comprises separate top and bottom hinge brackets connected to the top and bottom aluminum extrusions, respectively, each hinge bracket comprising a generally elongated rectangular portion and an aperture for connection to said cabinet means.

9. The door of claim 8 wherein said means to attach said frame members comprises L-shaped brackets dimensioned and adapted for insertion into correspondingly dimensioned and positioned grooves located in the end portions of adjacent aluminum extrusions.

10. The door of claim 9 wherein the L-shaped or hinge brackets or both are press-fit into the corresponding grooves or reception means, respectively.

11. The door of claim 1 wherein at least one of the frame members further comprises facing means capable of attachment to a side portion of each said frame member to provide decorative facing therefor.

12. The door of claim 1 wherein further comprising decorative panel means located in parallel spaced relation in front of said front panel means.

13. A door for at least partially obstructing an opening in a refrigeration cabinet wherein the temperature inside the cabinet is normally maintained lower that the outside temperature, comprising:

a plurality of extruded aluminum frame members of predetermined configuration, each member having at least two channels on its inner surface and being positioned in end to end engaged relation with adjacent members;

means positioned to attach each of said frame members to an adjacent member so as to form a rectangular frame of predetermined dimensions;

front and rear panel members configured and adapted for insertion into said channels so as to be retained in parallel spaced relation;

means to mount said plurality of frame members upon a refrigeration cabinet, each said mounting means being respectively attached to opposed frame members;

a thermal insulation medium positioned within a door interior space defined between said frame members and said front and rear panel members; and a continuous slot positioned between the front and rear portions of said frame members for thermally insulating said front portion of each of said frame members from said rear portion closer to the rear panel member of the door to break the thermal conductivity between said front and said rear portions of said frame members, said slot including a generally U-shaped wall extending across said slot and inwardly toward said door interior space, said wall having a continuous cut formed therein, wherein said rear portions and said rear panels are maintained in assembled relationship with the door by adhesion to said thermal insulation medium.

14. The door of claim 13 wherein the attachment means is L-shaped bracket means; and further comprising:

decorative facing means capable of attachment to a side portion of each frame member; and decorative panel means configured and adapted for insertion into a channel so as to be retained, located in parallel spaced relation in front of said front panel member.

15. A method for making a door which comprises:

providing a plurality of frame members in a predetermined configuration, each member having at least two channels on its inner surface and end portions configured and dimensioned for precise contact relation with adjacent members, and further having a continuous slot formed therein adjacent one of said channels including a generally U-shaped wall extending across the slot and inwardly toward the space to be defined as the interior of the door;

providing front and rear panel members in a predetermined configuration for insertion into said channels of said frame members;

simultaneously positioning and attaching each of said frame members to an adjacent member so as to form a rectangular frame of predetermined dimensions and for retaining said front and rear panel members in parallel spaced relation inserting said front and rear panel members into said channels prior to completing the attachment of said frame members, said rear panel member being inserted into said channel adjacent said slot;

inserting means for mounting said frame upon a structural member into said frame;

substantially filling the space defined by said frame members and said front and rear panels with a thermal insulating material so as to form an insulated door; and forming a continuous cut in each of said generally U-shaped walls as insulation means to break the thermal conductivity between said front and rear portions of said frame, whereby said rear portions and said rear panel member are held in assembled relationship with said door by adhesion to said thermal insulating material.

16. The method of claim 15 which further comprises providing means for insulating a front portion of said frame members from a rear portion.

17. The method of claim 15 which further comprises providing decorative facing means on at least a portion of a side of said frame members and providing at least one decorative panel means forward of said front panel member so as to provide a decorative door.

* * * * *